United States Patent [19]

Berfield

[11] Patent Number: 4,747,179

[45] Date of Patent: May 31, 1988

[54] NOZZLE WITH IMPROVED COUPLING FOR A VACUUM DEVICE

[75] Inventor: Robert C. Berfield, Jersey Shore, Pa.

[73] Assignee: Shop-Vac Corporation, Williamsport, Pa.

[21] Appl. No.: 55,689

[22] Filed: May 29, 1987

[51] Int. Cl.[4] ..... A47L 9/02

[52] U.S. Cl. ..... 15/415 R; 285/7; 285/371

[58] Field of Search ..... 15/415 R, 416; 285/7, 285/305, 351, 371, 398

[56] References Cited

U.S. PATENT DOCUMENTS

| | | | |
|---|---|---|---|
| 2,318,317 | 5/1943 | Lofgren | 285/7 |
| 2,659,616 | 11/1953 | Doyle | 285/7 |
| 3,069,186 | 12/1962 | Stevens | 285/7 |
| 3,159,412 | 12/1964 | Descarries | 285/7 |
| 3,286,295 | 11/1966 | Fromknecht | 285/7 X |
| 3,750,222 | 8/1973 | Johnson | 15/416 |
| 4,309,048 | 1/1982 | Ahlf et al. | 285/7 |
| 4,519,638 | 5/1985 | Vodoshi et al. | 285/351 X |

*Primary Examiner*—Chris K. Moore

*Attorney, Agent, or Firm*—Ostrolenk, Faber, Gerb & Soffen

[57] ABSTRACT

For attaching a rigid coupling to a nozzle for relative rotational freedom between them and for reducing the noise level at the connection between them, the coupling has a generally cylindrical arm to be received in a cylindrical opening into the nozzle. The arm of the coupling has a nonmetallic, plastic sleeve placed thereover, which is preferably in the form of two half cylinders. Grooves in the nonmetallic sleeve reduce the area of frictional contact between the sleeve and the nozzle. The nonmetallic sleeve has tabs at one end for passing through a gap in a ring in the nozzle to connect the coupling and the nozzle, while permitting relative rotation.

8 Claims, 3 Drawing Sheets

NOZZLE WITH IMPROVED COUPLING FOR A VACUUM DEVICE

BACKGROUND OF THE INVENTION

The present invention relates to a nozzle assembly for a vacuum device or a blower device, such as a vacuum cleaner or a blower with a nozzle, or the like, and more particularly to a structure for attaching a rigid coupling to a nozzle.

Tank type or canister type vacuum cleaners have a flexible hose connecting between the tank and the intake nozzle. Blowers have a hose leading from a fan or pressure source to an outlet nozzle.

A rigid coupling typically connects the flexible hose and the nozzle. It is desirable that there be rotational freedom between the coupling and the nozzle to enable the nozzle to be oriented for easy pick up, to be properly aimed and to permit the nozzle to be rotated with respect to the hose. The efficiency of a vacuum cleaner or blower also requires that the coupling between the hose and the nozzle be sufficiently sealed.

One such coupling is shown in U.S. application No. 938,850, filed Dec. 8, 1986 and assigned to the assignee of the present invention, entitled "Nozzle Assembly for a Vacuum Device". A bayonet type lock comprised of a projection from the coupling is passed through a gap in a ring inside the nozzle. Then the coupling and nozzle are rotated relative to one another, which connects the coupling and the nozzle. By forming the parts to mutually acceptable tolerances and making them a good fit, rotational ability of the nozzle with respect to the coupling is achieved while retaining the air seal. The rigid coupling here is comprised of metal such that its metal projection contacts the ring of the nozzle and rubs over it. The nozzle may also be of metal. Then, the metal-to-metal contact may produce relatively noisy operation, as the metal parts may rattle. Also, a nozzle of plastic material might still rattle from contact with the metal projections of the coupling, and the metal projections of the coupling might scrape the ring of the nozzle.

SUMMARY OF THE INVENTION

Accordingly, it is an object of the present invention to connects a rigid hose coupling to a nozzle with rotational freedom of the nozzle relative to the coupling and air sealing of the connection.

Another object of the invention is to provide such a connection between the coupling and the nozzle that is resistant to jamming due to dirt trapped in the connection region.

Yet another object is to minimize noises in the connection.

The nozzle and coupling for a vacuum cleaner, blower, or the like, in accordance with the present invention includes both a nozzle and a rigid coupling. The nozzle has one end that opens to the outside and a second end that includes and communicates into an opening that receives the coupling. That second end is generally cylindrical in cross section. The rigid coupling may have a bend in it, which would make it an elbow. The coupling also has a section with a generally cylindrical external profile for insertion into the opening of the nozzle. The inserted section of the coupling has a smaller diameter cross-section than the nozzle opening. The two opposed, annular surfaces of the inserted cylindrical section of the coupling and the cylindrical opening of the nozzle into which the coupling is inserted define an annular interface region. In this interface region there is a nonmetallic member which provides a slide bearing between the cylindrical surfaces and also provides a connection between the inserted coupling and the nozzle. In particular, the bearing is supported around the coupling inserted section.

The bearing may comprise a cylindrical plastic cover in the form of an annular band around the inner cylinder of the coupling. The band may be defined as a pair of half-cylindrical sections which are placed together. The annular band has at its end remote from the flexible hose a radial projection forming part of a bayonet lock for passing through a corresponding recess in a ring inside the nozzle opening. Rotation of the inserted coupling with respect to the nozzle locks the radial projection behind the ring to hold the coupling to the nozzle.

The nonmetallic, e.g. plastic, bearing permits coupling bearing-to-nozzle, either a plastic-to-metal or plastic-to-plastic, surface interengagement without the noise attendant on metal-to-metal surface contact.

While both the nozzle, and particularly its internal ring for engaging the coupling projection, and the coupling may be formed of metal, the nonmetallic, e.g. plastic sleeve, or cover for the section of the rigid coupling which is received in the nozzle opening decreases the friction between these members, decreases wear of metal rubbing upon plastic, decreases noise, decreases the amount of binding between moving parts which may occur and provides a simplified rotatable bayonet connection where the nozzle and the rigid coupling may rotate readily with respect to each other with a good air seal.

Further objects and features of the present invention will become apparent in the following description and drawings.

DETAILED DESCRIPTION OF A PREFERRED EMBODIMENT

Figure 1:
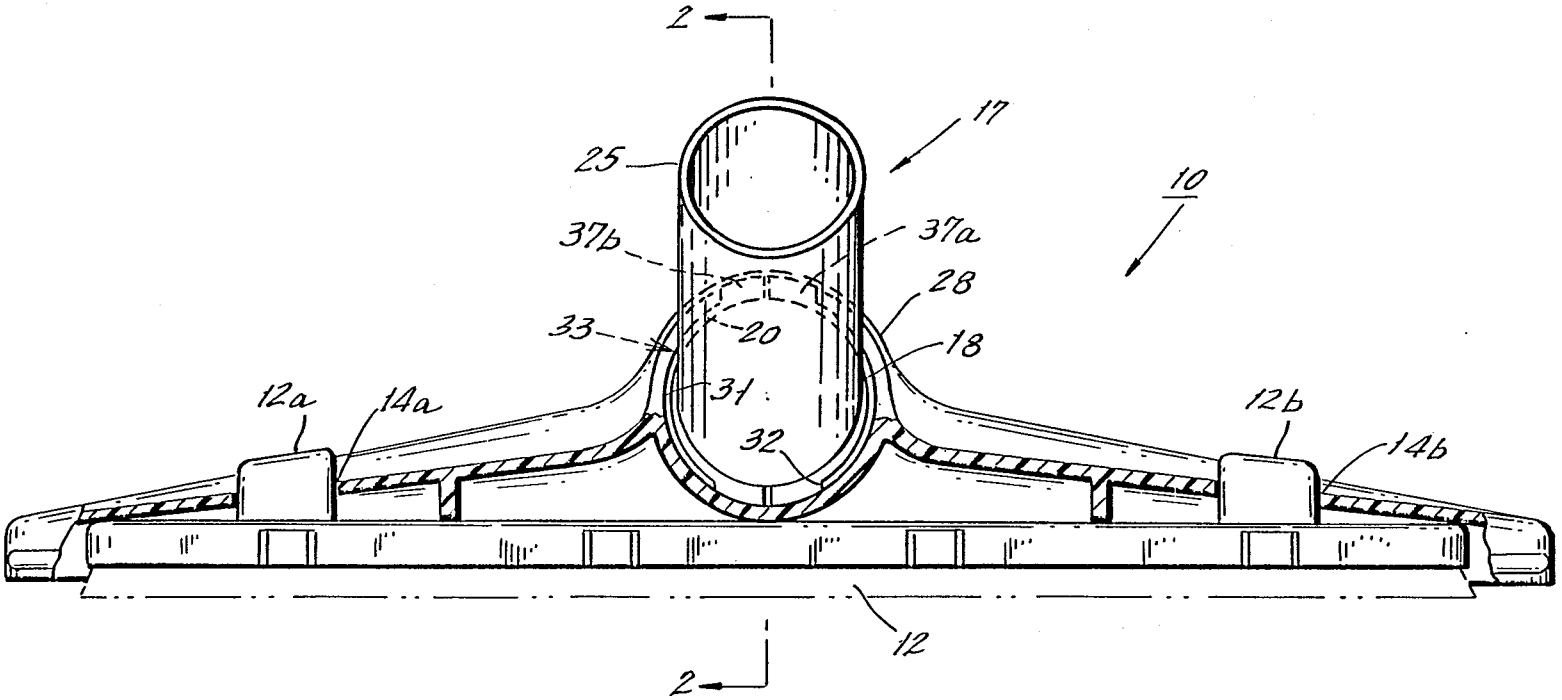
FIG. 1 is a rear view, partly in cross-section, of a nozzle assembly constructed in accordance with the present invention.
Figure 4:
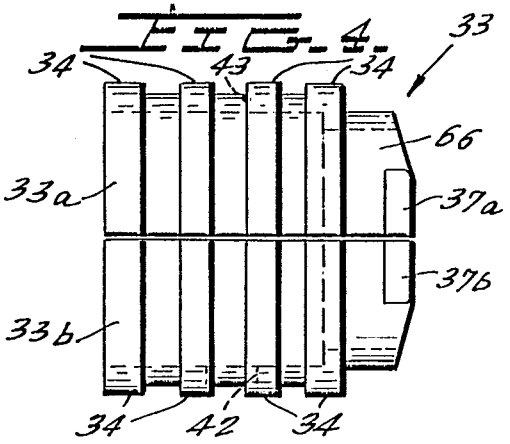
FIG. 4 is a view taken at 90° from the view of FIG. 3, showing a top view of the bearing of FIGS. 2 and 3.
Figure 3:
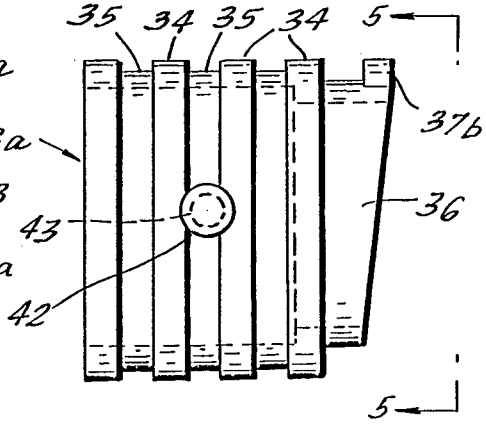
FIG. 3 is a side view of a plastic sleeve bearing placed over the right-hand end of the coupling of FIG. 2.
Figure 5:
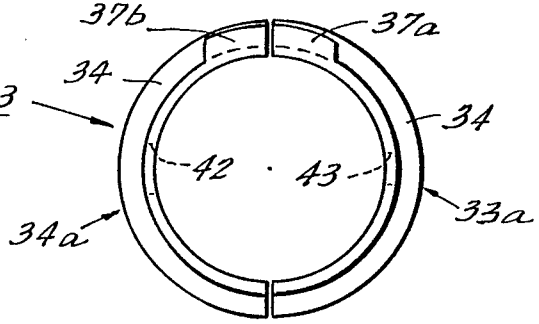
FIG. 5 is an end view of the right-hand end of the bearing of FIGS. 2, 3 and 4.

FIG. 1 shows a nozzle 10 which is used at the end of a hose of a vacuum cleaner. The invention may be used with a nozzle that is connected to a hose in any comparable arrangement, like a blower. The material of the nozzle 10 may be metal or molded plastic, as a particular design requires. The nozzle has a widened lower portion communicating outside the nozzle. The nozzle has a brush 12, extending across the widened lower portion of the nozzle and located rearwardly of the suction channel 13 in the nozzle 10 which connects to the outlet opening 18. The brush 12 or other similar attachment may be attached to the frame of the nozzle 10 by various known means, such as the projections 12*a* and 12*b* of the brush extending upwardly through the apertures 14*a* and 14*b* of the nozzle housing.

Figure 2:
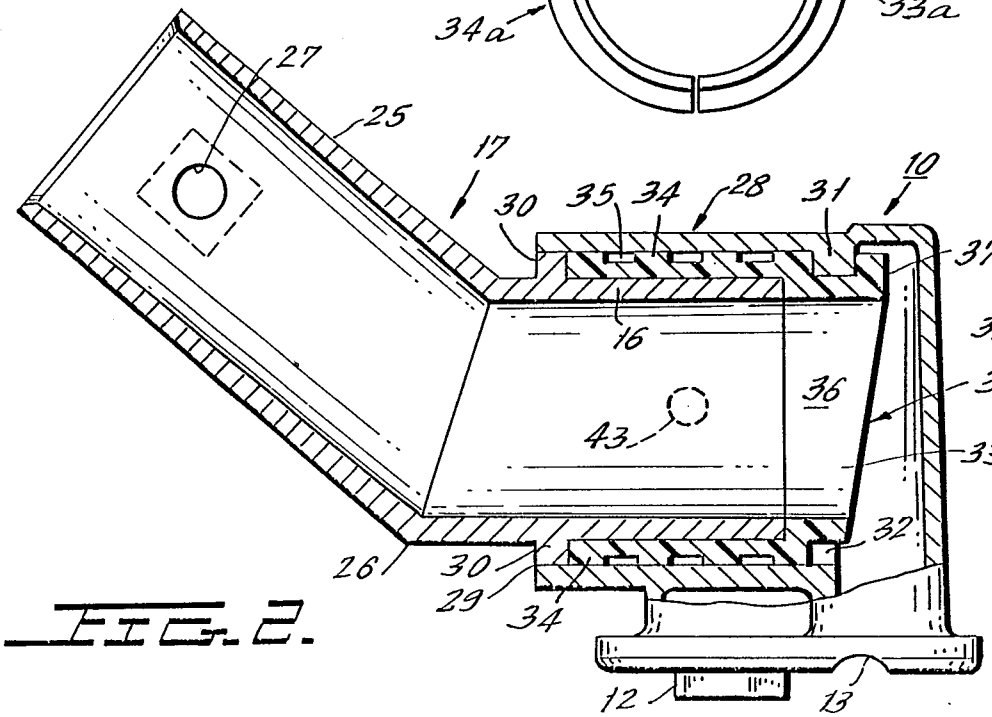
FIG. 2 is a cross-sectional view taken from line 2—2 of FIG. 1, looking in the direction of the arrows, showing a rigid coupling assembled into the nozzle assembly and rotated therein for locking of the coupling to the nozzle.

FIG. 2 shows a rigid hose coupling 17, which is hollow inside, comprising a first cylindrical arm 16 and a second cylindrical arm 25 which are rigidly connected at the bent elbow 26. Such a bent coupling is often referred to as an elbow. Connection means 27 releasably connect the coupling 17 to a hose end (not shown), and the hose is connected to a vacuum cleaner (not shown).

The nozzle 10 in FIG. 2 has a cylindrical cross-section receptacle 28 into which the cylindrical cross-section arm 16 of the coupling 17 is inserted from the open end 29 of the receptacle 28. At the open end the receptacle has an annular flange 30, which is of the cross-section of the inserted coupling arm 16 for air sealing the connection and helping to support the coupling against rocking. Well inside the receptacle 28 of the nozzle, away from the end 29, the receptacle 28 is provided with an integral, radially inwardly directed retaining ring 31 for holding the plastic bearing sleeve 33 hereinafter described. An arcuate gap 32 is provided in the ring 31 through which a lock tab 37 on the bearing sleeve 33 may pass.

The bearing sleeve 33 is a nonmetallic, and preferably plastic or resin, sleeve, which is fitted over the inner cylindrical arm 16 of the coupling 17 to provide a tight fitting, friction-reduced, slide bearing between the exterior of the arm 16 of the coupling 17 and the interior surface of the cylindrical receptacle 28 of the nozzle 10.

The sleeve 33 is seen in FIGS. 2–5. The end of the sleeve 33 rests against the annular, receptacle sealing flange 30 on the coupling arm 16, which is at the end 29 of the receptacle 28. The sleeve 33 has a plurality of annular rings 34, separated by annular recesses 35, around its exterior. The rings 34 bear upon the inner surface of the receptacle 28 defining the slide bearing there. The recesses 35 trap dirt particles which may have slipped between the sleeve 33 and the receptacle 28 and which might interfere with the free rotation of the nozzle with respect to the coupling 17.

In previous U.S. Pat. application Ser. No. 938,850, the bayonet lock tab or flange to connect the coupling arm and the nozzle is a metallic extension of the metallic coupling. In the present invention, noise reduction at the contact between the coupling and the nozzle is obtained by using a nonmetallic, plastic lock tab, rather than a metal one, with the tab defined on the bearing sleeve rather than on the coupling. Also, formation of the coupling arm 16, which is metal, is made easier when that arm is smooth surfaced and does not require a molded or bent up locking tab that is instead placed on the sleeve 33. The plastic bearing sleeve 33 has an axial extension 36 that includes the radially projecting lock tabs 37, which are preferably molded integrally with the sleeve 33.

For ease of assembly the sleeve 33 is made in two semicircular halves, 33*a* and 33*b*, each including a respective lock tab 37*a*, 37*b*. The sleeve halves 33*a*, 33*b* are placed together over the cylindrical coupling arm 16 prior to its insertion into the nozzle receptacle 28.

Figures 6, 7, 8, 9:
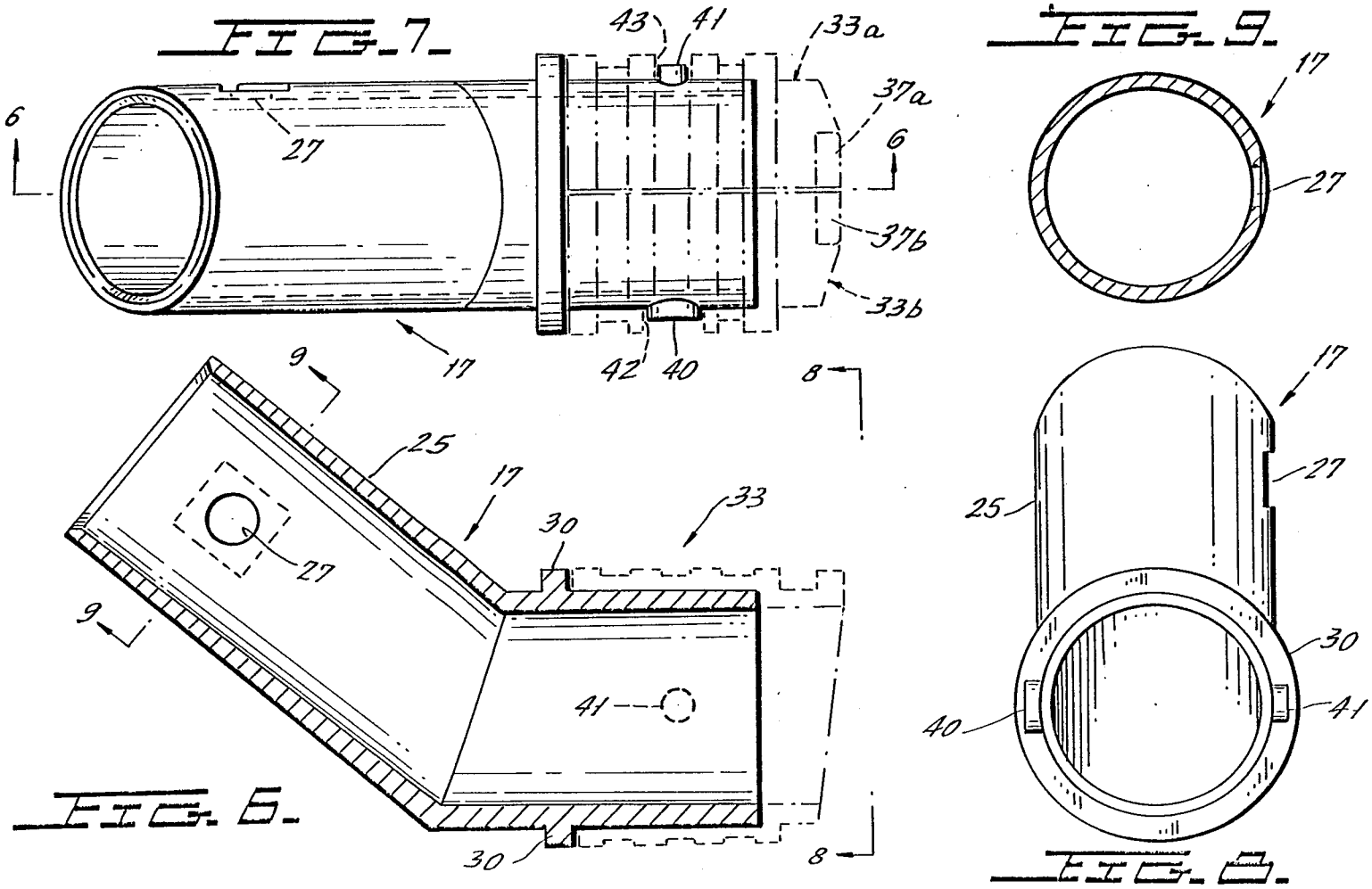
FIG. 6 is a cross-sectional view of the rigid coupling of FIG. 2.
FIG. 7 is a top view of the coupling of FIG. 6.
FIG. 8 is a head-on or end view of the coupling of FIG. 6.
FIG. 9 is a view, partly in section, taken along line 9 of FIG. 6.

Referring to FIGS. 7 and 8, there are sleeve half indexing projections 40, 41 of different sizes at opposite sides of the coupling arm 16. There are respective openings 42, 43 in the sleeve halves of sizes to match and receive the projections 40, 41 so that the halves 33*a* and 33*b* of sleeve 33 can only be placed on coupling arm 16 in one orientation, with the tabs 37*a*, 37*b* facing in the correct direction. An attempt to place the sleeve halves in an opposite direction would be blocked.

When the sleeve halves 33*a* and 33*b* are placed on coupling arm 16, the coupling 17 is slid into the nozzle receptacle 28, and is rotatively oriented therein so that the tabs 37*a* and 37*b* pass through the gap 32 in the ring 31. To prevent undesired separation of the coupling 17 and the nozzle 10, the tabs 37 are at the opposite side from the gap 32 when the coupling 17 is upright in use. After insertion of sleeve 33, rotation of coupling 17 moves the tabs 37*a*, 37*b* behind the ring 31 to lock the coupling in the nozzle receptacle 28, while still permitting free relative rotation.

In the foregoing, the connection of the nozzle with the rigid coupling, which in turn is connected to the hose of the vacuum cleaner, has the contacting surfaces between the cylindrical receptacle of the nozzle and the rigid coupling be plastic-to-plastic or metal-to-plastic at every point so that friction is reduced, and a source of noise or rattling from the possible metal-to-metal surface banging is avoided.

Although the present invention has been described in connection with a preferred illustrative embodiment thereof, many variations and modifications will now become apparent to those skilled in the art. It is preferred, therefore, that the present invention be limited not by the specific disclosure herein, but only by the appended claims.

What is claimed is:

1. A nozzle assembly for a vacuum device comprising:

a nozzle having a first end communicating outside the nozzle and having a second end defining a first opening of generally cylindrical shape and having an interior; a first ring portion on the nozzle interior, in the first opening;

a hollow coupling having a hollow coupling arm of generally cylindrical shape for insertion into the first opening and having an exterior opposed to the interior of the first opening, whereby the exterior of the coupling arm and the interior of the first opening define an interface region between them;

a nonmetallic sleeve encasing the coupling arm received within the first opening, contacting the interior of the nozzle, and forming a bearing between the coupling arm and the first opening;

a second complementary ring portion on the sleeve, the first and second ring portions being shaped such that with the nozzle and the coupling arm at one respective rotative orientation, the first and second ring portions pass by one another for permitting insertion and removal of the coupling arm in the first opening, and at a second rotative orientation, the ring portions engage for prohibiting the bypassage and thereby locking the nozzle and the coupling together.

2. The nozzle assembly of claim 1, wherein the sleeve has an exterior facing the interior of the nozzle and the sleeve exterior has a plurality of spaced recesses for receiving and containing debris and for reducing surface area of contact between the sleeve and the interior of the nozzle.

3. The nozzle assembly of claim 1, wherein the second ring portion of the sleeve comprises an arcuate radially outwardly projecting tab and the first ring portion includes a gap through which the tab can pass.

4. The nozzle assembly of claim 1, wherein the nonmetallic sleeve is of plastic material having a relatively low coefficient of friction with respect to the interior of the first opening.

5. The nozzle assembly of claim 1, wherein the sleeve is formed of two, part cylindrical sections placed together to form the sleeve as a cylinder.

6. The nozzle assembly of claim 5 wherein the sleeve sections have orienting means and the coupling arm has retaining means for cooperating with the orienting means to predetermine the orientation of the sleeve sections with respect to each other and the coupling arm.

7. The nozzle assembly of claim 6, wherein the sleeve has an exterior facing the interior of the nozzle and the sleeve exterior has a plurality of spaced recesses for receiving and containing debris and for reducing surface area of contact between the sleeve and the interior of the nozzle.

8. The nozzle assembly of claim 7, further comprising a sealing ridge around the coupling arm for engaging the sleeve sections toward the outside of the first opening.

* * * * *